US008337978B2

(12) United States Patent
Bhattacharyya et al.

(10) Patent No.: US 8,337,978 B2
(45) Date of Patent: Dec. 25, 2012

(54) RECORDING MATERIAL CONTAINING NONIONIC SURFACTANTS

(75) Inventors: Manoj K. Bhattacharyya, Palo Alto, CA (US); Hou T. Ng, Campbell, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 65 days.

(21) Appl. No.: 12/859,057

(22) Filed: Aug. 18, 2010

(65) Prior Publication Data

US 2012/0043035 A1 Feb. 23, 2012

(51) Int. Cl.

| | |
|---|---|
| ***B41M 3/10*** | (2006.01) |
| ***B44C 5/04*** | (2006.01) |
| ***G03G 7/00*** | (2006.01) |
| ***D21C 5/02*** | (2006.01) |

(52) U.S. Cl. ..... 428/211.1; 428/212; 428/219; 428/341; 162/5

(58) Field of Classification Search ..... 428/211.1, 428/212, 219, 341; 162/5

See application file for complete search history.

(56) References Cited

U.S. PATENT DOCUMENTS

| | | | | |
|---|---|---|---|---|
| 4,627,876 | A | 12/1986 | Fries et al. | |
| 5,198,024 | A | 3/1993 | Tuovinen et al. | |
| 5,801,135 | A | 9/1998 | Miyauchi et al. | |
| 5,885,413 | A | 3/1999 | Richmann et al. | |
| 7,592,434 | B2 | 9/2009 | Kerovuo et al. | |
| 2005/0137282 | A1 | 6/2005 | Cagle et al. | |
| 2005/0237369 | A1 | 10/2005 | Kosaka | |
| 2008/0138544 | A1* | 6/2008 | Balestra et al. | 428/32.31 |
| 2009/0130313 | A1 | 5/2009 | Ohshima et al. | |
| 2009/0165967 | A1 | 7/2009 | Rosencrance et al. | |
| 2009/0186162 | A1 | 7/2009 | Namba et al. | |
| 2009/0258196 | A1* | 10/2009 | Nagashima et al. | 428/195.1 |
| 2010/0173079 | A1 | 7/2010 | Akiyama et al. | |
| 2010/0175584 | A1 | 7/2010 | Kusaka et al. | |
| 2010/0180795 | A1 | 7/2010 | Ezaki et al. | |

FOREIGN PATENT DOCUMENTS

| | | |
|---|---|---|
| EP | 0307024 | 3/1989 |
| JP | 07-084395 | 3/1995 |
| JP | 2000-214623 | 8/2000 |
| WO | WO 92/20750 | 11/1992 |
| WO | WO 02/094973 | 11/2002 |
| WO | WO 2008/114849 A1 * | 9/2008 |

OTHER PUBLICATIONS

Gleisner, R. and Blankenburg, J., Semiannual Patents Review: Jul. 2002-Dec. 2002. (Research Paper) Progress in Paper Recycling, vol. 12, No. 3, pp. 26-33 [online], May 2003 [retrieved on Mar. 31, 2010]. Retrieved from the Internet: <URL: http://www.fpl.fs.fed.us/documnts/pdf2003/gleis03a.pdf>.

(Continued)

*Primary Examiner* — Betelhem Shewareged

(57) ABSTRACT

A recording material, containing nonionic surfactants, including: a supporting substrate, a first bottom base coat applied to at least one surface of said substrate, and a second topcoat layer applied over said bottom base coat. The supporting substrate or the bottom base coat includes nonionic surfactants that have HLB values that are inferior to 15. Also disclosed is a method to deink printed waste papers wherein the waste papers contain recording materials, containing nonionic surfactants such as defined herein.

18 Claims, 2 Drawing Sheets

OTHER PUBLICATIONS

Gecol, H., et al., "Use of Surfactants to Remove Water Based Inks
Gecol, H., et al., "Use of Surfactants to Remove Solvent-Based Inks from Plastic Films", Colloid Polym Sci, 2003, 281: 1172-1177. from Plastic Films", Colloids & Surfaces A: Physicochemical & Engineering Aspects, Science Direct, 2001, 2pg.

Gecol, H., et al., Deinking of Water-Based Ink Printing from Plastic Film Using Nonionic Surfactants, Jrnl. of Surfactants and Detergents, vol. 5, No. 4, 2002, pp. 363-374.
"Indigo Guide to Sapphire Treatment", Indigo, Version 2.0, Sep. 1996.

* cited by examiner

RECORDING MATERIAL CONTAINING NONIONIC SURFACTANTS

BACKGROUND

For many decades, the paper industry has been practicing waste paper recycling to regenerate usable cellulosic fiber, for paper making, in processes called deinking processes. In these deinking processes, ink is removed from the waste paper pulp by a series of chemical and physical steps. In paper recycling processes, the deinking is carried out by converting the waste papers to a pulp and then contacting the pulp with specific compositions. Such composition induces swelling of the fiber and reduces reattachment of the ink particles to the fiber while, often, stabilizing the ink particles. The ink particles and other impurities from the pulp fiber are then released and separated.

In inkjet printing process, papers are often printed with water-based inks. In offset, laser and digital printing processes, different kind of inks, such as toner and electrostatic printing inks, are used. The use of these various inks often make the deinking process less efficient and more complex for achieving good results. Indeed, during offset, laser and digital printing processes, heat and/or pressure are applied to cause ink particles to fuse to paper surfaces. The resulting printing papers are thus very difficult to deink.

Nowadays, papers printed with laser and digital printing processes represent important volumes in the area of waste papers recycling. The industry is thus working on developing effective processes and chemistries that will help obtaining superior performances in deinking such waste paper slurries.

BRIEF DESCRIPTION OF THE DRAWING

The drawings illustrate various embodiments of the present system and method and are part of the specification.

DETAILED DESCRIPTION

Before particular embodiments of the present invention are disclosed and described, it is to be understood that the present disclosure is not limited to the particular process and materials disclosed herein. It is also to be understood that the terminology used herein is used for describing particular embodiments and is not intended to be limiting. In describing and claiming the present disclosure, the following terminology will be used: the singular forms "a", "an", and "the" include plural referents unless the context clearly dictates otherwise. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight range of approximately 1 wt % to about 20 wt % should be interpreted to include not only the explicitly recited concentration limits of 1 wt % to about 20 wt %, but also to include individual concentrations such as 2 wt %, 3 wt %, 4 wt %, and sub-ranges such as 5 wt % to 15 wt %, 10 wt % to 20 wt %, etc. Wt % means herein percentage by weight. All percents are by weight unless otherwise indicated.

The present disclosure refers herein to a recording material. In some embodiments, the recording material is a media recording surface based on paper substrate. In some examples, such media recording surface is well adapted to be used in offset printing process, in laser printing process and/or in digital printing processes. The media recording surface is often referred to as electrostatic media recording surface. In addition, the recording material is a media well adapted for inkjet printing device and also for laser or digital printing machine.

Figure 1:
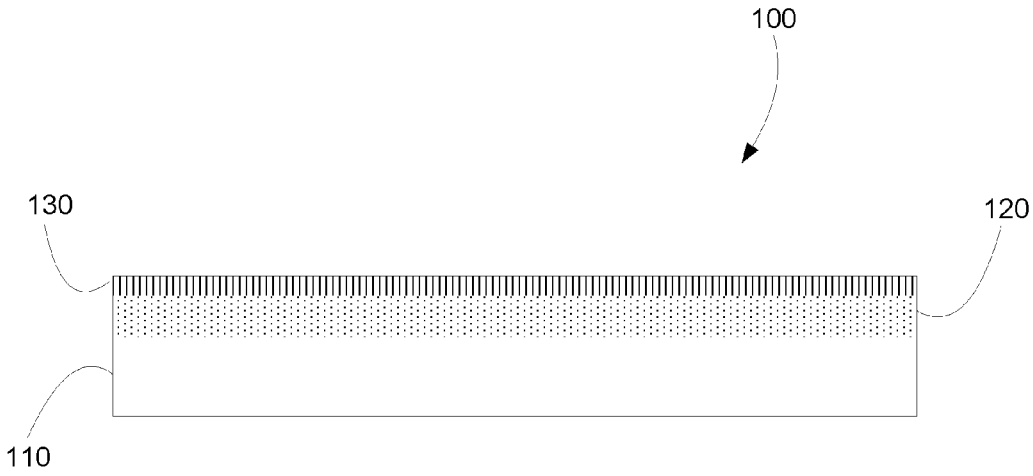
FIG. 1 is a cross-sectional view of a recording material, including coating compositions that are applied to one side of the supporting substrate, according to embodiments of the present disclosure.
Figure 2:
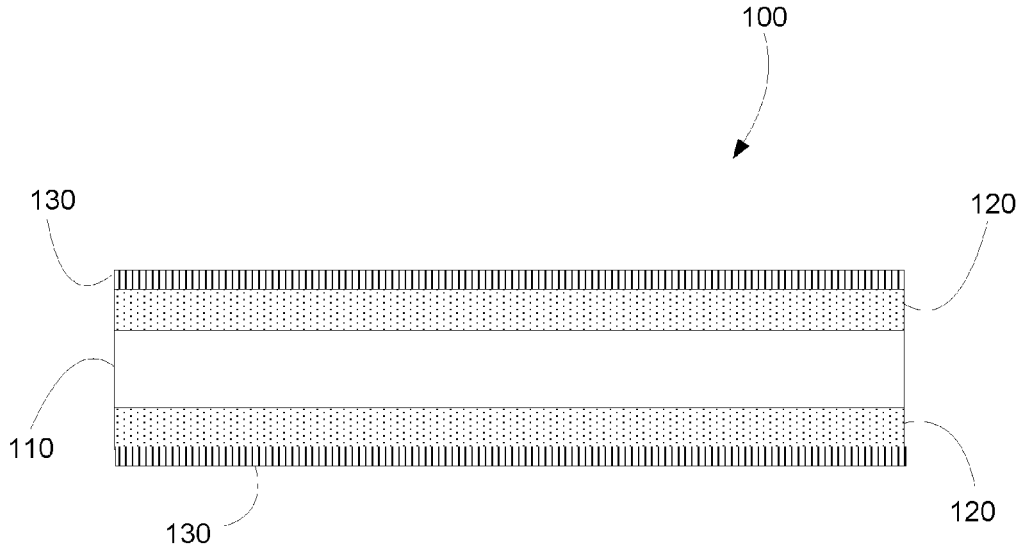
FIG. 2 is a cross-sectional view of a recording material, including coating compositions that are applied to both sides of the supporting substrate, according to embodiments of the present disclosure.

In some embodiments, as illustrated in FIGS. 1 and 2, the recording material (100) contains a supporting substrate (110), a first bottom base coat (120) applied to at least one surface of said substrate (110), and a second topcoat layer (130) applied over said bottom base coat (120). Within such recording material, the supporting substrate (110) or the bottom base coat (120) includes nonionic surfactants having HLB values that are inferior to 15. The nonionic surfactants can be included in the bottom base coat (120) of the recording material or can be included in the supporting substrate (110) of the recording material. The nonionic surfactants can also be included in the supporting substrate (110) and in the bottom base coat (120) of the recording material (100).

Figure 3:
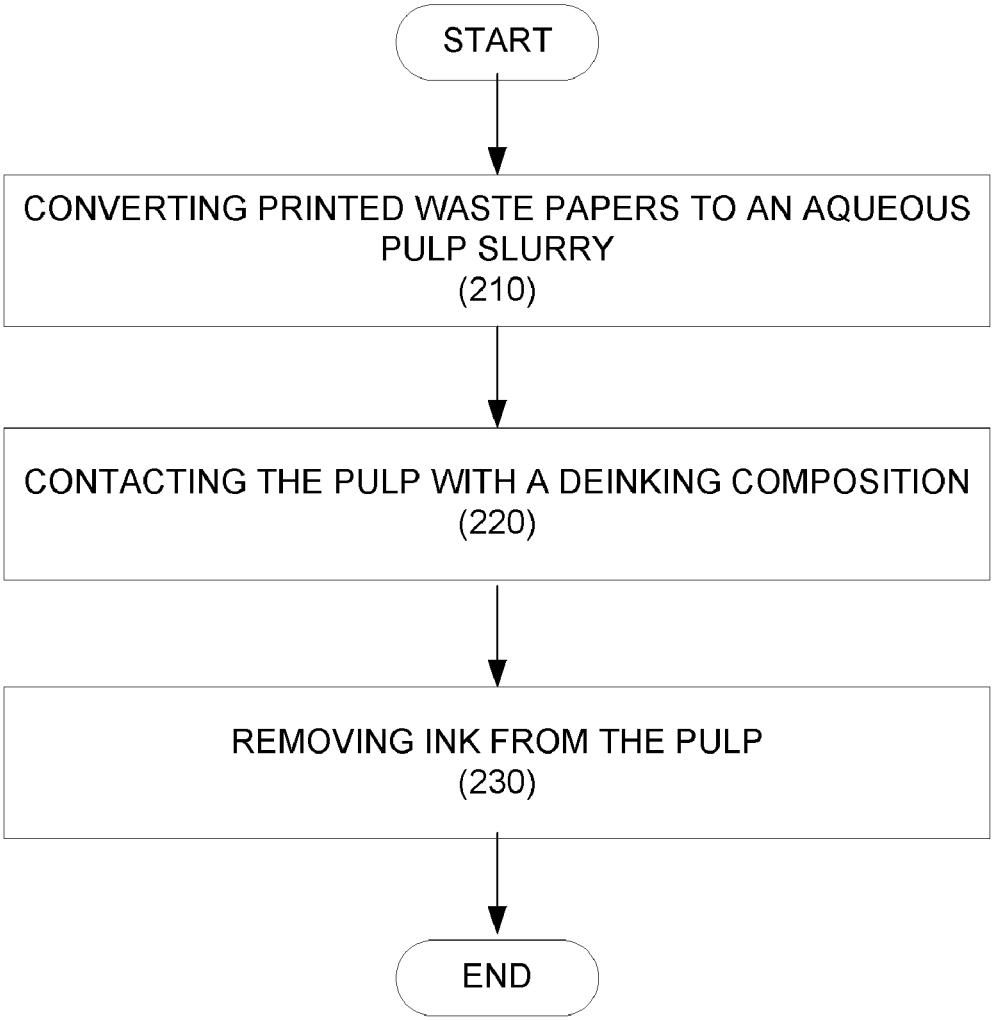
FIG. 3 is a flow chart illustrating a method to deink waste papers according to embodiments of the present disclosure.

Such as illustrated in FIG. 3, embodiments of the present disclosure encompass also a method to deink printed waste papers. Such method includes converting printed waste papers to an aqueous pulp slurry (210), contacting the pulp with a deinking composition including deinking agent (220), and removing ink from the pulp (230) wherein, in such method, waste papers contain recording materials (100) that include a supporting substrate (110), a first bottom base coat (120) applied to at least one surface of said substrate, and a second topcoat layer (130) applied over said bottom base coat; wherein the supporting substrate or the bottom base coat includes nonionic surfactants having HLB values that are inferior to 15.

Such recording material can be easily deinked when used in deinking process, meaning thus that the deinking process is very efficient when such recording material is used as raw materials. Without being bound by any theory, it is believed that such recording material, containing nonionic surfactants having HLB values that are inferior to 15, when used in deinking process, results in paper pulp that does not contain ink residues. The ink removal is particularly efficient and results in excellent quality, high value deinked products. Such method produces then paper pulp that has both excellent brightness and low effective residual ink concentrations ("ERIC") even when the recording material has been printed with various ink compositions, i.e. using laser and/or digital printing processes. The term "effective residual ink concentration (ERIC)," as used herein, means a value that is a measure of the effect of the remaining ink or of the overall darkening effect of the residual ink. The lower the ERIC value, the lower the amount of residual ink on the fiber. A lower ERIC value is, therefore, an indication of increased deinking performance. The ERIC value is also used by mills, research facilities, and product development facilities to determine ink removal efficacy in paper sheet.

In some embodiments, such as illustrated in FIGS. 1 and 2, the recording material (100) includes a supporting substrate (110) and, at least, two ink-receiving layers comprising a first bottom base coat (120) applied to at least one surface of said substrate (110) and a second topcoat layer (130) applied over said bottom base coat (120).

In some examples, such as illustrated in FIG. 1, the bottom base coat (120) and the topcoat layer (130) are applied to one side of the supporting substrate (110). If the coated side is used as an image-receiving side, the other side, i.e. backside, may not have any coating at all, or may be coated with other chemicals (e.g. sizing agents) or coatings to meet certain features such as to balance the curl of the final product or to improve sheet feeding in printer.

In some other examples, such as illustrated in FIG. 2, the bottom base coat (120) and the topcoat layer (130) are applied to both opposing sides of the supporting substrate (110). The double-side coated medium has a sandwich structure, i.e., both sides of the supporting substrate (110) are coated with the same coating and both sides may be printed with images or text.

The recording material (100) includes a supporting substrate (110), a first bottom base coat (120) applied to at least one surface of said substrate, a second topcoat layer (130) applied over said bottom base coat, wherein the supporting substrate (110) or the bottom base coat (120) includes nonionic surfactants that have HLB values inferior to 15. The nonionic surfactants can be used in the bottom base coat of the recording material, as a binder.

In some examples, the nonionic surfactants have one of the general formulas: $R_1$—$(OR_2)_n$—OH, $R_1$—O—$(OR_2)_n$—H or $R_1$—$C_6H_4$—$(OR_2)_n$—OH. Within such formulas, $R_1$ can be a branched, cyclic or unbranched alkyl group, each group having from 3 to 20 carbon atoms. In some examples, $R_1$ is a substituted or an unsubstituted alkyl group having from 3 to 20 carbon atoms. In some other examples, R1 is a substituted or un-substituted alkyl group containing from 6 to 18 carbon atoms. In yet some other examples, R1 is a substituted or an unsubstituted alkyl group containing from 12 to 18 carbon atoms or R1 is an unsubstituted alkyl group containing from 12 to 18 carbon atoms. Within such formulas, $R_2$ can be $CH_2CH_2$ or $CH_2CH_2CH_2$. In some examples, n is an integer ranging from 2 to 100; in some other examples, ranging from 2 to 50, and in yet some other examples, ranging from 2 to 20.

In some embodiments, the nonionic surfactants have the formula: $R_1$—$(OR_2)_n$—OH or $R_1$—O—$(OR_2)$—H or $R_1$—$C_6H_4$—$(OR_2)_n$—OH, wherein $R_1$ is a branched, cyclic or unbranched alkyl group, having from 3 to 20 carbon atoms, wherein $R_2$ is $CH_2CH_2$ or $CH_2CH_2CH_2$ and wherein n ranges from 2 to 100. In some other embodiments, the recording material contains nonionic surfactants having the formula $R_1$—$(OR_2)_n$—OH or $R_1$—O—$(OR_2)$—H or $R_1$—$C_6H_4$—$(OR_2)_n$—OH, wherein $R_1$ is a substituted or un-substituted alkyl group having from 6 to 18 carbon atoms, wherein $R_2$ is $CH_2CH_2$ and wherein n ranges from 2 to 50.

In some examples, the nonionic surfactants have the formula $R_1$—$(OR_2)_n$—OH, wherein $R_1$ is $C_{16}H_{33}$, $C_{12}H_{25}$ or $C_{18}H_{35}$; $R_2$ is $CH_2CH_2$ and n is an integer ranging from 2 to 20. In some other examples, n is 2, 4, 10 or 20. In yet some other examples, the nonionic surfactants have the formula $R_1$—O—$(OR_2)_n$—H wherein $R_1$ is $C_{18}H_{37}$; $R_2$ is $CH_2CH_2$ and n is 8.

In some embodiments, the nonionic surfactants have HLB values that are inferior to 15. In some other embodiments, the nonionic surfactants have HLB values that are between about 5 and about 15. In yet some other embodiments, the nonionic surfactants have HLB values that are comprised between about 8 and about 13. As used herein, the term "HLB value" refers to the "hydrophilic-lipophilic balance" value of a molecule. The HLB value increases thus with increasing hydrophilicity. The HLB value of a surfactant can be calculated according to Griffin W C: "Classification of Surface-Active Agents by HLB, Journal of the Society of Cosmetic Chemists 1 (1949): 311; and Griffin W C: "Calculation of HLB Values of Nonionic Surfactants", Journal of the Society of Cosmetic Chemists 5 (1954): 259.

Nonionic surfactants can be present in an amount representing from about 0.05 to about 2 weight percent by total weight of the recording media. In some examples, nonionic surfactants are present in an amount representing from about 0.2 to about 0.8 weight percent by total weight of the recording media. In some other examples, nonionic surfactants are present in an amount representing from about 0.4 to about 0.7 weight percent by total weight of the recording media.

The supporting substrate (110) may take the form of a media sheet or of a continuous web suitable for use in a printer. The supporting substrate (110) may be a base paper manufactured from cellulose fibers. The base paper may be produced from chemical pulp, mechanical pulp, thermal mechanical pulp and/or the combination of chemical and mechanical pulp. In some examples, the base paper may also include conventional additives such as internal sizing agents and fillers. The internal agents can be added to the pulp before it is converted into a paper web or substrate. The fillers can be any particular types used in paper making process. As a non-limiting example, the fillers may be selected from calcium carbonate, talc, clay, kaolin, titanium dioxide and combinations thereof. The supporting substrate (110) can be an uncoated raw paper or a pre-coated paper. In some examples, the supporting substrate is paper substrate having a basis weight of from about 100 to about 250 g/m2. In some other examples, the supporting substrate is a base paper having a regular B size (11"×17") sheet with a basis weight of 90 g/m$^2$. In yet some other examples, the supporting substrate includes nonionic surfactants, such as defined above, that have HLB values inferior to 15.

The recording material (100) includes, in addition to the supporting substrate (110), a first bottom base coat (120) and a second topcoat layer (130) that is applied over said bottom base coat. The bottom base coat layer (120) of the recording material (100) can have a coat weight ranging from about 10 to about 30 g/m$^2$ (gram per square meter). In some examples, the bottom base coat of the recording material has a coat weight ranging from about 15 to about 25 g/m$^2$ (gram per square meter). The bottom base coat layer (120) can include a combination of deinking surfactants. In some embodiments, the bottom base coat (120) has a formulation that includes deinking nonionic surfactants that have HLB values inferior to 15.

In some examples, the topcoat layer (130) has a coat weight ranging from about 1 to about 10 gram per square meter (g/m$^2$). In some other examples, the topcoat layer (130) has a coat weight in the range of about 1 to about 5 gram per square meter (g/m$^2$). The topcoat layer (130) can contain silica type of pigment. In some examples, the topcoat layer (130) contains pigments selected from the group consisting of ground calcium carbonate (gcc), precipated calcium carbonated (pcc), kaolin clay, talc, fumed silica, silica gel, precipitated silica, colloidal silica, fumed alumina, boehmite, pseudo-boehmite and a mixture thereof. Fumed silica pigment is composed of agglomerates of many non-porous particles of amorphous silica particles with particle size in the nanometer range (e.g., 5 to 20 μm), produced by high temperature hydrolysis of silicon tetrachloride. A silica gel pigment includes porous amorphous silica particles with internal small pores, and can be manufactured from acid treatment of sodium silicate solution.

The bottom base coat and topcoat layer formulations can include other ingredients such as polymeric pigments, binders and/or coating additives and any mixture thereof. The bottom base coat and topcoat layer formulations may include polymeric co-pigments. Suitable polymeric co-pigments include plastic pigments (e.g., polystyrene, polymethacrylates, polyacrylates, copolymers thereof, and/or combinations thereof). Suitable solid spherical plastic pigments are commercially available from The Dow Chemical Company, e.g., DPP 756A or HS 3020. The amount of polymeric co-pigments in the coating composition may be in the range of 1 part to 10 parts based on 100 parts of inorganic pigment. The bottom base coat and topcoat layer formulations can contain one or more binders that may include, but are not limited to, polyvinyl alcohol and derivatives thereof (e.g. carboxylated polyvinyl alcohol, sulfonated polyvinyl alcohol, aceto-acetylated polyvinyl alcohol, and mixtures thereof), polystyrene-butadiene, polyethylene-polyvinyacetate copolymers, starch, gelatin, casein, alginates, carboxycellulose materials, polyacrylic acid and derivatives thereof, polyvinyl pyrrolidone, casein, polyethylene glycol, polyurethanes (for example, a modified polyurethane resin dispersion), polyamide resins (for instance, an epichlorohydrin-containing polyamide), a poly(vinyl pyrrolidone-vinyl acetate) copolymer, a poly(vinyl acetate-ethylene) copolymer, a poly(vinyl alcohol-ethylene oxide) copolymer, mixtures thereof, and others without restriction.

The bottom base coat and topcoat layer formulations may also contain other coating additives such as rheology modifiers, defoamers, optical brighteners, biocides, pH controlling agents, dyes, and other additives for further enhancing the properties of the coating. Among these additives, rheology modifier is useful for addressing runnability issues. Suitable rheology modifiers include polycarboxylate-based compounds, polycarboxylated-based alkaline swellable emulsions, or their derivatives.

Both the first bottom base coat (120) and the second topcoat layer (130) can be applied to the supporting substrate (110) using any one of a variety of suitable coating methods, such as blade coating, air knife coating, metering rod coating, curtain coating or another suitable technique in view of obtaining the recording material. After the coating steps, the coated medium can be then subjected to a drying process to remove water and other volatile components in the coating layers and in the substrate. The drying means includes, but is not limited to, infrared (IR) dryers, hot surface rolls, and hot air floatation dryers. After coating, the coated medium may be calendered to increase glossiness and/or to impart a satin surface. When a calendering step is incorporated, the coated medium may be calendered by an on-line or an off-line calender machine, which may be a soft-nip calender or a supercalender. The rolls in a calender machine may be heated and pressure can be applied to the calendering rolls.

Such as illustrated in FIG. 3, an example method to deink printed waste papers includes: converting printed waste papers to an aqueous pulp slurry (210); contacting the pulp slurry with a deinking composition including deinking agent (220), and removing ink from the pulp (230), wherein the waste papers contain recording materials that include a supporting substrate, a first bottom base coat applied to at least one surface of said substrate, a second topcoat layer applied over said bottom base coat, wherein the supporting substrate or the bottom base coat includes nonionic surfactants having HLB values that are inferior to 15.

In some embodiments, the method includes converting printed waste papers to an aqueous pulp wherein the deinking composition is added during the conversion of the printed waste papers to an aqueous pulp.

The terms "printed waste papers" or "waste papers", as used herein, mean any papers having printed images or characters such as newsprint, magazines, telephone directories, printed advertising materials, laser and other digital printed materials, computer paper, legal documents, book stock, corrugated containers, or a mixture thereof. In some examples, the "printed waste papers" or "waste papers" contain recording materials such as defined above, i.e. that include a supporting substrate, a first bottom base coat applied to at least one surface of said substrate, a second topcoat layer applied over said bottom base coat, wherein the supporting substrate or the bottom base coat includes nonionic surfactants having HLB values that are inferior to 15. The paper fibers used to produce these materials may be chemically pulped materials, such as Kraft pulps, or may be mechanical produced pulps, such as ground wood or mixtures thereof. Such waste papers may also contain adhesive or tacky contaminants.

In some examples, the waste papers are digital or laser printed waste papers. By digital printing papers, it is meant herein papers that have been printed using digital printing process. By laser printing papers, it is meant papers that have been printed using laser technology and/or by the use of dry toner. Within such process, the ink is effectively removed from waste fibers in order to permit the reuse of the fibers. These new uses include the manufacture of, for example, newsprint, hygiene papers and high quality papers.

In some examples, the ink is removed from the pulp by firstly, separation from the aqueous pulp slurry and then the deinked paper pulp is recovered from the aqueous pulp slurry. The printed waste papers can be converted to aqueous pulp slurry in a vessel that is known in the art as a "pulper" or "repulper". When converting waste papers to a pulp (210), i.e. the repulping stage, the waste papers can be treated in aqueous alkaline conditions with a deinking composition. The deinking composition and agent can be added at this stage, although these components may be added later just prior to the actual separation of the ink (i.e., washing or flotation steps). The repulping stage can be followed by coarse cleaning or screening to remove the relatively coarse contaminants (such as staples, plastic, etc. . . . ) from the pulp. The pulp can then be processed by wash deinking, flotation deinking or a combination of both.

In some examples, when converting waste papers to a pulp (210), such conversion occurs at a temperature ranging from about 25° C. to about 85° C., in some other examples at a temperature ranging from about 30° C. to about 75° C.; and in yet some other examples at a temperature ranging from about 40° C. to about 60° C. The aqueous pulp slurry can contain from about 5% to about 35% of printed waste paper pulp by weight.

The pulped aqueous slurry may be subjected to additional cleaning, screening, and washing stages where ink and other contaminants are separated from the cellulosic fiber stream. The deinked pulp may also be subsequently thickened and bleached to the target brightness prior to being sent to the paper machine where supplements, such as strength aids, drainage aids, and/or paper sizing agents, may be added. The physical pulping and the alkalinity of the aqueous medium cause at least the partial removal of ink from the pulp fiber. The deinking agent completes this removal and produces an aqueous suspension and/or dispersion of the ink particles.

In some examples, the deinking method is conducted by pulping printed waste paper materials in the presence of a deinking composition. The pulp can be contacted with a deinking composition in the same time as the waste papers are converted into a pulp. In some examples, the deinking process encompasses contacting printed waste paper pulp with the deinking composition during a period of from about 1 minute to about 120 minutes. In some other examples, the contacting step (220) occurs during a period of from about 4 minutes to about 90 minutes. The printed waste paper pulp can be contacted with the deinking composition at a pH ranging from about 6.5 to about 11.5, at a pH ranging from about 8.8 to about 11.5, at a pH ranging from about 7.2 to about 9.0, or at a pH ranging from about 6.8 to about 7.8. In some examples, the printed waste paper pulp is contacted with the deinking composition under alkaline deinking conditions: the pH of the contacting step ranges from about 9 to about 11. In some other examples, the printed waste paper pulp is contacted with the deinking composition under reduced alkali deinking conditions, the pH of the contacting step ranges from about 7.5 to about 8.8.

In some embodiments, the deinking composition contains deinking agent such as surfactants. In some examples, the deinking agents are anionic surfactants. Non limiting examples of surfactants include linear alkyl sulfates, branched alkyl sulfates, alkyl ether sulfates and/or fatty acid or fatty acid soaps. In some other examples, the surfactants are phosphate surfactants. Non-limiting examples of deinking agents include also alkyl sulfates, sodium dodecyl sulfate (SDS), 1-octanesulfonic acid sodium salt, docusate sodium, lithium dodecyl sulfate, N-lauroylsarcosine sodium salt, N-lauroylsarcosine, Niaproof® 4, sodium 1-butanesulfonate, sodium 1-decanesulfonate, sodium 1-nonanesulfonate, sodium 1-heptanesulfonate, sodium 1-propanesulfonate, sodium dodecylbenzenesulfonate, sodium hexanesulfonate, sodium octyl sulfate and sodium pentanesulfonate. The deinking composition can be an alkaline aqueous deinking composition containing a deinking agent such as sodium laurel sulfate (SLS) or sodium laureth sulfate (SLES).

The amount of deinking agent present in the aqueous medium of the pulper can be from about 0.01 to about 5.0 wt % based upon the dry weight of all papers added to the pulper. In some examples, the range is from about 0.05 to about 1 wt %. In some other examples, the amount of surfactant present in the aqueous medium of the pulper ranges from about 0.1 to about 0.8 wt %.

The aqueous medium of the pulper may includes, in addition to the deinking agent, commonly known deinking additives. Such additives include, but are not limited to bleaches, hydrogen peroxide, sodium silicate, chelants, sequestrants, and dispersants other than the defined surfactants, coagulants, detergent builders, other detergents and the like. Additional chemicals may also be added to the pulper such as sodium hydroxide or soda ash to control the pH of the composition in the pulper. Alkali metal phosphates and silicates may also be added to modify the properties of the composition in the pulper.

The method of deinking waste papers includes also the separation of the ink from the printed waste paper pulp in the aqueous slurry (230). The deinking process may encompasses recovering deinked paper pulp from the aqueous pulp slurry. Different methods can be employed to isolate and to recover the ink and ink related entities in order to produce the deinked fiber after repulping. Such methods are known as wash deinking, flotation deinking or a combination of both methods. Flotation deinking involves the interaction between ink particles, air bubbles and fibers. The ink particles, which are rendered hydrophobic by deinking surfactants, attach to the air bubble surfaces and float upwards towards the top of the flotation device. Under commonly used conditions, the fiber will remain hydrophilic and will neither attach to the air bubbles nor float during the flotation process. In the case of wash deinking, ink particles are kept well dispersed in the aqueous phase by surfactants. The ink particles are separated from the fibers by a repeated flow of water passing by the fibers through a screen. This wash deinking technology involves multiple dilution and thickening stages.

In some example, the slurry is maintained in the flotation cell for a time, temperature and rate of agitation useful to produce foam that contains a significant amount of the removed ink. Such conditions often comprise treating the slurry at a temperature of about 40° C. to about 50° C. for about 1 to about 60 minutes, injecting air into the cell in an amount sufficient to disperse air bubbles throughout the mixture, with good agitation and without becoming so turbulent as to dislodge ink from the air bubbles. This amount of injection is often about 1 cell volume of air per minute. The concentration of the paper fibers is about 0.5 to about 2% of the cell. In the flotation process, the foam that forms above the slurry in the flotation can be removed by methods known in the art such as by a scraper. From the remaining slurry, papers can be produced which have a high level of brightness. Alternatively, the remaining slurry may be subjected to additional processing steps such as post flotation, wash and bleaching/washing procedures to yield even more superior paper products.

Without being linked by any theory, it is believed that, during the pulping step, in the recycling mills, the nonionic surfactants having HLB values inferior to 15, such as describe above, and that are present in the supporting substrate (110) or in the bottom base coat (120) of the recording media (100) will interact to form the desired composite particles which will interact with the aerated air bubbles during flotation and be removed.

The deinking method provides thus improved deinking performances. Indeed, the resulting printed waste paper pulp obtained from the deinking method such as defined herein, are used to make papers having excellent brightness and ERIC values.

The preceding description has been presented to illustrate and describe embodiments of the present invention. Although certain example methods, compositions, apparatus and articles of manufacture have been described herein, the scope of coverage of this patent is not limited thereto. On the contrary, this patent covers all methods, apparatus and articles of manufacture fairly falling within the scope of the claims either literally or under the doctrine of equivalents.

Example 1

Recording Media

Several recording media are prepared according to formula 1 to 7 (see Table 1). In Table 1, all numbers represent the wt % of the different components based on the total weight of the recording material. In all formulations listed, chemicals are mixed together in a beaker by using a normal bench stirring equipment and are kept stirring overnight. Each coating liquids are then coated on a base paper stock by using a lab scale single roller blade coater (Euclid Coating Systems Inc) at a coat weight of 20 g/m$^2$ for the bottom base coat and at a coat weight of 2 g/m$^2$ for the topcoat. The topcoat layer is applied over the bottom base coat. The base paper is a regular B size (11"×17") sheet with a basis weight of 90 g/m$^2$ (from International Paper). The coated samples are then dried by a normal heat gun. After drying, the coated paper is then calendered using two passes with a lab calender machine under a pressure of 3200 psi, at 130° F. temperature. The samples are then printed using Indigo HP 55000 presses and using Indigo LEP EI4.0 ink.

TABLE 1

| | Formula 1 | Formula 2 | Formula 3 | Formula 4 | Formula 5 | Comparative Formula 6 | Comparative Formula 7 |
|---|---|---|---|---|---|---|---|
| bottom base coat formulation | | | | | | | |
| Pigment: Opacarb ® A40 (PCC) | 5 | 5 | 5 | 5 | 5 | 5 | 5 |
| Pigment: Ansilex ® 93 (clay) | 2.5 | 2.5 | 2.5 | 2.5 | 2.5 | 2.5 | 2.5 |
| Pigment: Gasil ® 23F (silica gel) | 1.5 | 1.5 | 1.5 | 1.5 | 1.5 | 1.5 | 1.5 |
| Pigment: Sylojet ® A-25 (silica gel) | 0.4 | 0.4 | 0.4 | 0.4 | 0.4 | 0.4 | 0.4 |
| Binder: Mowiol ® 40-88 | 9 | 9 | 9 | 9 | 9 | 9 | 9 |
| Binder: Acronal ® S728 | 0.9 | 0.9 | 0.9 | 0.9 | 0.9 | 0.9 | 0.9 |
| Defoamer: Foamaster ® VF | 0.07 | 0.07 | 0.07 | 0.07 | 0.07 | 0.07 | 0.07 |
| Surfactants: | | | | | | | |
| Brij52 | 0.6 | — | — | — | — | — | — |
| Brij30 P4391 | — | 0.6 | — | — | — | — | — |
| Myrj45 | — | — | 0.6 | — | — | — | — |
| Brij97 | — | — | — | 0.6 | — | — | — |
| Brij98 | — | — | — | — | 0.6 | — | — |
| Brij700 | — | — | — | — | — | 0.6 | — |
| Methoxy PEG 350 | — | — | — | — | — | — | 0.6 |
| Water | Up to 100% | | | | | | |
| Topcoat formulation | | | | | | | |
| PCC | 5.0 | 5.0 | 5.0 | 5.0 | 5.0 | 5.0 | 5.0 |
| Kaolin clay | 2.0 | 2.0 | 2.0 | 2.0 | 2.0 | 2.0 | 2.0 |
| Starch | 1.0 | 1.0 | 1.0 | 1.0 | 1.0 | 1.0 | 1.0 |
| Poly Vinyl alcohol | 1.2 | 1.2 | 1.2 | 1.2 | 1.2 | 1.2 | 1.2 |
| Styrene butadiene Rubber | 1.1 | 1.1 | 1.1 | 1.1 | 1.1 | 1.1 | 1.1 |
| Water | Up to 100% | | | | | | |

In the bottom base coat compositions, different surfactants are used. Table 2 below illustrates the surfactant formulations and their HLB values. All surfactants are available from Sigma Aldrich.

TABLE 2

| Surfactant: | formulation | HLB value |
|---|---|---|
| Brij 52 | $C_{16}H_{33}$—$(OCH_2CH_2)_2OH$ | 5 |
| Brij 30 P4391 | $C_{12}H_{25}$-$(OCH_2CH_2)_4OH$ | 9 |
| Myrj45 | $H(OCH_2CH_2)_8$—$OCH_2(CH_2)_{16}CH_3$ | 11.1 |
| Brij97 | $C_{18}H_{35}$—$(OCH_2CH_2)_{10}OH$ | 12 |
| Brij98 | $C_{18}H_{35}$-$(OCH_2CH_2)_{20}OH$ | 15 |
| Brij700 | $C_{18}H_{37}$-$(OCH_2CH_2)_{100}OH$ | 18 |
| Methoxy PEG 350 | $CH_3$—$(OCH_2CH_2)_{12}OH$ | 19 |

Example 2

Deinking Process

The recording materials, such as obtained in the example 1, are used in deinking process, as printed waste paper, and are converted into an aqueous pulp waste.

The step of converting waste papers to an aqueous pulp slurry is done in a Hobart® pulper. The pulper is filled with 200 g oven-dry printed waste papers of example 1, with 400 ml of sodium hydroxide, sodium silicate and hydrogen peroxide solution and up to a total volume of 1233 ml with water to reach a consistency of 15%. The pulper is run during a few seconds and is stopped. The waste papers are brushed down and scraped from the wall of the pulper. The sock is then disintegrated for 20 min at approximately 45° C. using rotor speed 2.

This pulping step is then followed by coarse cleaning to remove the contaminants. The pulp is then processed in a flotation process. Labor Flotation Cell Delta2 (from Voith Paper GmbH & Co.) are used for the flotation step. The cell is filled half way with 45° C. water. The paper pulp is then added into the flotation cell. A sodium dodecyl sulfate (SDS) solution, dissolved in water in the range of 0.05 to 1.5 wt % (based upon the dry weight of all papers added to the pulper) is added into the flotation cell and is mixed for about 30 seconds. More water at 45° C. is added into the flotation cell so that water level is about 1.5-2 inches below the rotating blade of the cell. Air supply is set to point 8 on the scale (approx. 7 L/min). The flotation cell is run for about 10 minutes. At the end of the flotation step, paper sheets are made based on the row material obtained.

The results of the deinking process are illustrated in Tables 3A and B below wherein: UP represents measurements of Un-deinked Pulp and DP represents measurements on Deinked Pulp.

Samples of paper pulp are analyzed in the laboratory under standardized conditions. These tests deliver values for luminosity, color change, dirt particle area and ink elimination. The parameters evaluated are quality characteristics of the deinked pulp: brightness, color and cleanliness [luminosity (Y), colour shade (a*) and dirt particle area (A) in two size classes: one for all visible dirt particles larger than 50 μm and one for visible dirt particles larger than 250 μm]. IE represents the ink elimination and ΔY represents the discoloration of the filtrate. "Spec" represents residual ink on hand sheets. "Spec contamination" (Spec. cont.) represents residual ink area on hand sheets. The deinking score is given according to "European Recovery Paper Council" assessment rule. The maximum number of points that can be attained is 100. If a product fails to meet one of the threshold values, it is to be regarded as "not suitable for deinking". DP ash content is measured according to Tappi T413 standard.

TABLE 3A

| | UP | | DP | | | | | | |
|---|---|---|---|---|---|---|---|---|---|
| Recording media | Av. Spec. Dia (μm) | Spec. Cont. ($mm^2/m^2$) | Av. Spec. Dia (μm) | Spec. Cont. ($A_{50}/A_{250}$) ($mm^2/m^2$) | $IE_{700}$ (%) | Y | ΔY (pt) | a* | De-inking Score |
| Formula 1 | 136.5 | 12 859 | 133.9 | 700/180 | 76 | 86 | 1.0 | 0.39 | 95 |
| Formula 2 | 133.3 | 10 348 | 134.9 | 610/170 | 80 | 88 | 0.5 | 0.25 | 99 |
| Formula 3 | 223 | 13 769 | 104.6 | 59.2/0 | 85 | 86 | 0.5 | 0.58 | 100 |
| Formula 4 | 128 | 13 300 | 118.7 | 84/0 | 75 | 89 | 0 | 0.90 | 100 |
| Formula 5 | 176.3 | 17 582 | 170.5 | 566/160 | 81 | 86 | 0.1 | 0.65 | 100 |
| Comparative Formula 6 | 167.6 | 10331 | 197.4 | 3352/2275 | 75 | 88 | 0.2 | 0.32 | Un-deinkable |
| Comparative Formula 7 | 233.6 | 13643 | 225 | 40545/9538 | 75 | 81 | 1.0 | 0.39 | Un-deinkable |

TABLE 3B

| Recording media | Flotation Yield (%) | DP Ash Content (%) |
|---|---|---|
| Formula 1 | 52.0 | 12.80 |
| Formula 2 | 58.7 | 7.10 |
| Formula 3 | 63.0 | 5.30 |
| Formula 4 | 56.0 | 6.20 |
| Formula 5 | 55.0 | 5.50 |
| Comparative Formula 6 | 54.5 | 5.35 |
| Comparative Formula 7 | 51.0 | 3.60 |

The invention claimed is:

1. A recording material, containing nonionic surfactants, comprising:

a. a supporting substrate, b. a first bottom base coat applied to at least one surface of said substrate, c. a second topcoat layer applied over said bottom base coat, wherein the supporting substrate or the bottom base coat includes nonionic surfactants having HLB values that are less than or equal to 15, and wherein the nonionic surfactants are chosen from $C_{18}H_{35}$—$(OCH_2CH_2)_{10}OH$ and $C_{18}H_{35}$—$(OCH_2CH_2)_{20}OH$.

2. The recording material such as defined in claim 1 wherein the nonionic surfactants are part of the supporting substrate.

3. The recording material such as defined in claim 1 wherein the nonionic surfactants are part of the bottom base coat.

4. The recording material such as defined in claim 1 wherein the nonionic surfactants have HLB values ranging between about 12 and about 15.

5. The recording material such as defined in claim 1 wherein the nonionic surfactants represent from 0.05 to 2 weight percent per total weight of the recording material.

6. A recording material, containing nonionic surfactants, comprising:

a. a supporting substrate, b. a first bottom base coat applied to at least one surface of said substrate, c. a second topcoat layer applied over said bottom base coat, wherein the supporting substrate or the bottom base coat includes nonionic surfactants having HLB values that are inferior to 15, and wherein the nonionic surfactants have the formula: $R_1$—O—$(OR_2)_n$—H; wherein $R_1$ is a substituted or un-substituted alkyl group having from 6 to 18 carbon atoms; wherein $R_2$ is $CH_2CH_2$; and wherein n ranges from 2 to 50.

7. The recording material such as defined in claim 1 wherein the supporting substrate is a base paper manufactured from cellulose fibers.

8. The recording material such as defined in claim 1 wherein the bottom base coat layer of the recording material has a coat weight ranging from about 10 to about 30 $g/m^2$.

9. The recording material such as defined in claim 1 wherein the topcoat layer has a coat weight ranging from about 1 to about 10 gram per square meter ($g/m^2$).

10. The recording material such as defined in claim 6 wherein the nonionic surfactant is H $(OCH_2CH_2)_8$—$OCH_2(CH_2)_{16}CH_3$.

11. The recording material such as defined in claim 6 wherein the nonionic surfactants represent from 0.05 to 2 weight percent per total weight of the recording material.

12. The recording material such as defined in claim 6 wherein the bottom base coat layer of the recording material has a coat weight ranging from about 10 to about 30 $g/m^2$, and wherein the topcoat layer has a coat weight ranging from about 1 to about 10 $g/m^2$.

13. A method to deink printed waste papers, comprising:

a. converting printed waste papers to an aqueous pulp slurry, b. contacting the pulp with a deinking composition including a deinking agent, c. and removing ink from the pulp, wherein the waste papers contain recording materials, containing nonionic surfactants, comprising the formulation of claim 6.

14. A method to deink printed waste papers, comprising:

a. converting printed waste papers to an aqueous pulp slurry, b. contacting the pulp with a deinking composition including a deinking agent, c. and removing ink from the pulp, wherein the waste papers contain recording materials, containing nonionic surfactants, comprising: a supporting substrate, a first bottom base coat applied to at least one surface of said substrate, and a second topcoat layer applied over said bottom base coat, wherein the supporting substrate or the bottom base coat includes nonionic surfactants having HLB values that are less than or equal to 15, and wherein the nonionic surfactants are chosen from $C_{18}H_{35}$—$(OCH_2CH_2)_{10}OH$ and $C_{18}H_{35}$—$(OCH_2CH_2)_{20}OH$.

15. The method such as defined in claim 14 wherein the deinking composition comprises anionic surfactant as the deinking agent.

16. The method such as defined in claim 14 wherein the deinking composition is an alkaline aqueous deinking composition containing sodium laurel sulfate or sodium laureth sulfate as the deinking agent.

17. The method such as defined in claim 14 wherein the deinking agent represents from about 0.01 to about 5.0 weight percent per total dry weight of papers added to the pulper.

18. The method as defined in claim 14 wherein the waste papers are digital or laser printed waste papers.

* * * * *